US005513519A

United States Patent [19]

Cauger et al.

[11] Patent Number: 5,513,519

[45] Date of Patent: May 7, 1996

[54] METHOD OF MEASURING CHANGES IN THE ENERGY TRANSFER EFFICIENCY OF A THERMAL TRANSFER SYSTEM

[75] Inventors: David M. Cauger, 65 Main St. #10, Hudson, Mass. 01749; Andrew Sanford, Beverly, Mass.

[73] Assignee: David M. Cauger, Hudson, Mass.

[21] Appl. No.: 311,414

[22] Filed: Sep. 23, 1994

[51] Int. Cl.[6] ..... G01L 3/26

[52] U.S. Cl. ..... 73/112; 364/551.01

[58] Field of Search ..... 73/112; 364/506, 364/511, 512, 551.01

[56] References Cited

U.S. PATENT DOCUMENTS

| | | | |
|---|---|---|---|
| 2,341,407 | 2/1944 | Xenis et al. | 73/112 |
| 2,593,659 | 4/1952 | Dickey | 73/112 |
| 2,593,661 | 4/1952 | Dickey | 73/112 |
| 2,596,030 | 5/1952 | Junkins | 73/112 |
| 4,029,465 | 6/1977 | LaHaye et al. | 432/179 |
| 4,060,379 | 11/1977 | LaHaye et al. | 432/179 |
| 4,144,020 | 3/1979 | LeHaye et al. | 432/19 |
| 4,296,727 | 10/1981 | Bryan | 73/112 |
| 4,360,336 | 11/1982 | Shepherd | 431/12 |
| 4,565,788 | 1/1986 | Milovidov et al. | 73/112 |
| 4,685,072 | 8/1987 | Johnson et al. | 364/551.01 |
| 4,941,113 | 7/1990 | Dundics et al. | 73/112 |

*Primary Examiner*—Richard Chilcot
*Assistant Examiner*—Eric S. McCall
*Attorney, Agent, or Firm*—Brian M. Dingman

[57] ABSTRACT

A method of quantitatively measuring energy transfer efficiency changes resulting from modifications in a boiler system, comprising: measuring the amount of fuel used by the boiler to produce a certain quantity of energy in its output; making modifications to the boiler system; measuring the amount of fuel used by the boiler, after the modifications, to produce the same certain quantity of energy; and determining the difference in the measured fuel usages as a measure of the effectiveness of the boiler system modifications.

2 Claims, 6 Drawing Sheets

METHOD OF MEASURING CHANGES IN THE ENERGY TRANSFER EFFICIENCY OF A THERMAL TRANSFER SYSTEM

FIELD OF INVENTION

This invention relates to a method of measuring the energy transfer efficiency change resulting from the introduction of a device, system, or method of operation to a thermal transfer system.

BACKGROUND OF INVENTION

It has always been a goal to increase the energy transfer efficiency, within practical financial limits and operating specifications, of systems which involve heat transfer. Examples of such systems include: steam boilers which typically burn fossil fuel to convert water to steam for use in heating, cooling, process manufacturing, or the driving of turbines to produce electricity; oil refinery furnaces which burn fossil fuel to heat crude oil to produce various petroleum products; and food processing systems which use fossil fuel to heat vegetable oil to produce a variety of products. It is a goal of such systems, within practical financial limits and operating specifications, to transfer as much of the heat value of the fuel as possible to the substance or material being heated. Many of these systems burn millions of dollars of fuel per year, and thus small changes in efficiency can translate into large monetary savings.

The standard basis for measuring efficiency of boilers is the ASME power test code 4.1. This test code employs two measurement methods: input-output, and heat-loss. These methods are theoretically equivalent, and are considered to be measures of the effectiveness of the boiler in extracting the available heat energy of the fuel. In the input-output method, the efficiency is measured as the amount of heat absorbed by the water and steam, compared to the energy input of the fuel.

This method requires the accurate measurement of fuel input. Also, accurate data must be available on steam pressure, steam temperature, steam flow, feed water temperature, stack temperature, and air temperature. The heat-loss method subtracts individual energy losses from 100% to obtain percent efficiency. The losses measured include heat loss due to dry gas, heat loss due to moisture in the fuel, heat loss due to water from the combustion of hydrogen, heat loss due to combustibles in coal refuse, heat loss due to radiation, and other unmeasured losses. The major contributor to the heat loss is the flue gas.

Although these calculations can be accurate, they require the testing party to gather a large amount of data, and thus are cumbersome to perform. In addition, these tests are performed under a range of operating variables that may comprise only a small percent of the actual range of operating variables the equipment operates under. The input-output method demands precision instruments to measure such items as steam pressure, steam temperature, steam flow, fuel input, feed water temperature, stack temperature, and air temperature. Furthermore, a steam plant may not be able to support testing for long periods of time because of practical considerations such as the demand of steam required to produce required electricity.

In the above described methods, accurately measuring the change in efficiency resulting from the introduction of a device, system, or operational method to the thermal transfer system would be difficult to quantify, as only a small range of operating variables may be observed before and after such introduction. Additionally, significant changes in operating variables such as a high wind velocity may be present before the introduction, but not present after the introduction, thereby affecting the objective of a controlled comparison. Additionally, operating variables have within themselves attributes that affect other operating variables, thereby creating an interrelationship that cannot be expressed under the above methods. An example of this is barometric pressure. At very low barometric pressures, less air is available to mix with the fuel. However, this may be offset by high winds that can occur at low pressures: the high winds at the stack can pull more volume of this low density air into the system's burner.

SUMMARY OF INVENTION

It is therefore an object of this invention to provide a method of measuring the energy transfer efficiency changes resulting from the introduction to the thermal transfer system of one or more modifications to the system, for example one or more devices, systems or methods of operation, The modification, or modifications, are hereinafter referred to as "modifications". This is accomplished by making measurements under defined ranges of variables before the modifications and then again after the modification under the same defined ranges of variables, in order to determine the net effect of the modifications in terms of energy transfer efficiency.

It is a further object of this invention to provide such a method which can be performed automatically using a microcomputer.

It is a further object of this invention to provide such a method which can be performed over any desired time interval.

It is a further object of this invention to provide such a method which can be performed continuously if desired.

It is a further object of this invention to provide such a method which takes into account weather conditions affecting efficiency.

It is a further object of this invention to provide such a method which takes into account any measurable variable condition that affects efficiency.

This invention results from the realization that the energy transfer efficiency of systems which transfer heat energy, such as boiler systems, can be determined by measuring the amount of fuel required to create a predefined quantity of energy at the system output. The effect on efficiency resulting from modifications made to the system may then be determined by determining the difference in the amount of fuel required to create the same amount of energy after the modifications.

This invention features a method of quantitatively measuring energy transfer efficiency changes resulting from modifications in a boiler system, comprising: measuring the amount of fuel burned by the boiler to produce a predefined quantity of energy in its output; making the modifications to the boiler system; measuring the amount of fuel burned by the boiler after the modifications to produce the same predefined quantity of energy; and determining the difference in the measured fuel usages as a measure of the effectiveness of the boiler modifications. The method may further include measuring a number of operating variables while fuel usage is being measured, and correlating the measured values of these variables with the fuel burned by the boiler to produce a predefined quantity of energy, to establish baseline conditions before the boiler system modifications. Determining the difference in fuel usage may include finding the baseline conditions which match the variable values during fuel usage measurement after the boiler modifications. Determining the difference in fuel usage may further include resolving the measured amount of fuel used by the boiler to produce the predefined quantity of energy for the found baseline conditions, and comparing the measured amount of fuel used by the boiler after the modifications, to the resolved measured amount of fuel.

Also featured is a method of determining changes in energy usage resulting from modifications in a thermal transfer system in which a number of system variables are measured, comprising: (a) selecting a quantity of transferred energy as a thermal transfer trigger point; (b) establishing a database with a number of entries, each including a value for each operating variable, and a fuel quantity value; (c) periodically measuring and storing the values of the operating variables, until the thermal transfer trigger point is reached; (d) determining the quantity of fuel used to transfer the selected quantity of energy; (e) determining a single representative value for all of the stored values for each variable; (f) creating a database entry including the representative value for each variable, and the determined quantity of fuel; (g) before the system modifications, repeating steps (c) through (f) for a period of time to establish a meaningful baseline database; (h) after the modifications, repeating steps (c) through (e); (i) finding the database entry with the operating variable values most closely matching the respective single representative values for the operating variables determined after the modifications; (j) retrieving the fuel quantity value which is part of the found database entry; and (k) comparing the quantity of fuel used to transfer the selected quantity of energy after the modifications, to the retrieved fuel quantity value to determine the effect of the modifications on the amount of fuel required to result in the transfer of the selected quantity of energy under the matching operating variables.

Also featured is a method of measuring the energy transfer efficiency change resulting from a modifications in a thermal transfer system, comprising: measuring the transfer of a predetermined quantity of energy, and the amount of fuel used by the system to accomplish the energy transfer; making the modifications to the thermal transfer system; after the modifications, measuring the amount of fuel used by the system to accomplish the transfer of the same predetermined quantity of energy; and determining the difference in the measured fuel usage as a measure of the effectiveness of the thermal transfer system modifications.

In another embodiment, featured is a method of measuring the energy transfer efficiency change resulting from a modifications in a thermal transfer system, comprising: measuring the usage of a same predetermined quantity of fuel, and the resulting quantity of energy transferred; making the modifications to the thermal transfer system; after the modifications, measuring the quantity of energy transferred during the usage of the predetermined quantity of fuel; and determining the difference in the measured quantities of energy as a measure of the effectiveness of the thermal transfer system modifications.

Another embodiment features a method of determining changes in energy usage resulting from modifications in a thermal transfer system in which a number of system variables are measured, comprising: establishing a quantity of one variable as a thermal transfer trigger point; operating the system and periodically measuring and storing the system variable values, until the trigger point is reached; making the modifications to the thermal transfer system; after the modifications, operating the system and periodically measuring the system variable values, until the trigger point is reached; and determining, from the values of at least one system variable both before and after the modifications, the effectiveness of the thermal transfer system modifications. The variables may include the quantity of fuel used and the quantity of energy transferred, and the step of establishing a quantity of one variable as a thermal trigger point may then include establishing a quantity of energy transferred as the trigger point. The step of determining the effectiveness of the thermal transfer system operating change may then include comparing the quantities of fuel used both before and after the modifications to determine the change in fuel usage caused by the modifications, as a measure of the effectiveness of the thermal transfer system modifications.

The step of establishing a quantity of one variable as a thermal transfer trigger point may alternatively include establishing a quantity of fuel used as the trigger point, and then the step of determining the effectiveness of the thermal transfer system modifications may include comparing the quantities of energy transferred both before and after the operating change to determine the change in energy transfer efficiency caused by the modifications, as a measure of the effectiveness of the thermal transfer system modifications.

BRIEF DESCRIPTION OF THE DRAWINGS

Other objects, features and advantages will occur to those skilled in the art from the following description of the preferred embodiment and the accompanying drawings, in which.

DESCRIPTION OF THE PREFERRED EMBODIMENT

Figure 1:
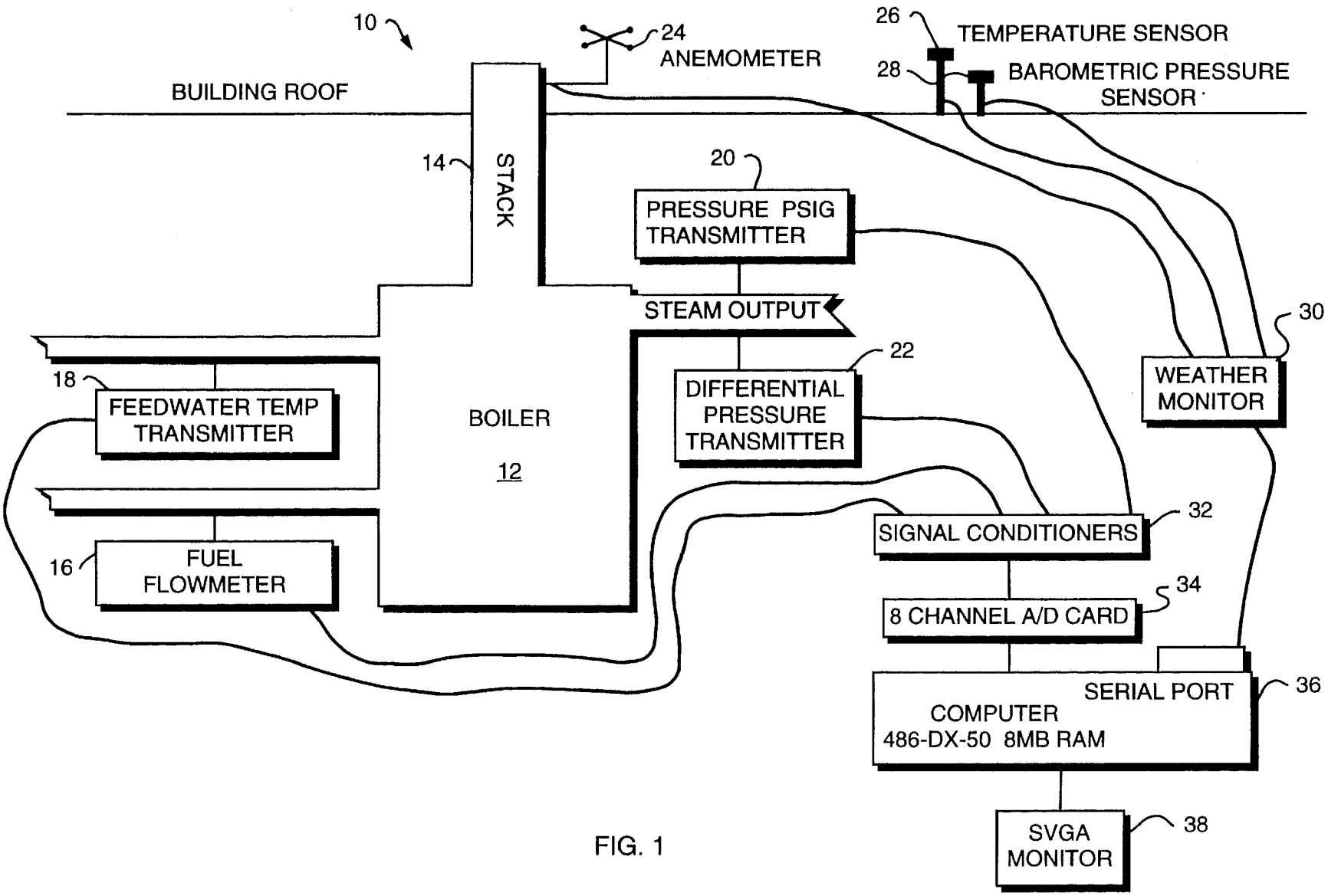
FIG. 1 is a schematic diagram of a boiler system employing the method of this invention.

This invention may be accomplished in methods of measuring the energy transfer efficiency changes resulting from modifications made to a thermal transfer system. In the preferred embodiment, the method is accomplished by measuring the amount of fuel used by the energy transfer system to produce a predefined quantity of energy at the system output, making the modifications, and then again measuring the amount of fuel used to produce the same quantity of energy at the system output, under the same operating conditions as the test performed before the modifications, to determine the fuel conservation associated with the modifications. Alternatively, the amount of fuel used may be the constant, and the output energy may be the measured variable.

In order to make accurate, meaningful comparisons of data taken before and after system modifications, it is important to build a baseline database which includes such fuel usage/energy creation data across a wide range of possible operating conditions of the thermal transfer system. This database may be created by identifying system variables in advance, and taking measurements of the operating variables before making the modifications. An amount of output energy to be used as the comparison point, called the "trigger point" herein, is determined in advance. The system is then operated under different conditions, and measurements of all the system variables are made over the time it takes to create a trigger point amount of energy. The values of each of the operating variables over this time are then averaged and stored in the database along with the amount of fuel used to create the trigger point amount of energy. Preferably, the trigger point is chosen to be small enough such that these baseline tests are of short enough duration so that there is not a great variation in the values of the variables during any given test. The variables which change most rapidly are wind speed near the top of the stack and system load. Furthermore, the values of the variables are preferably measured or sampled at a rate of at least once per second.

A measurement range is determined in advance for each of the variables. For example, the range of outside temperatures could be selected to be between −10° F. and 110° F. This range for each of the variables is then divided into a number of equal-sized increments, called "bins" herein. For example, there may be 12 bins for temperature, each encompassing ten degree increments. To simplify the use of the database, each variable has the same number of bins. The total number of possible combinations of bins is therefore equal to the number of bins, raised to the power equal to the number of independent variables. Thus, if there are two bins, and three variables, there are $2^3$, or 8, possible combinations of bins. Accordingly, a table with eight entries will provide a database which has an entry for each possible combination of bins.

Fuel usage data is provided for each database entry in the baseline database established before the modifications. Since it will likely not be possible to actually take measurements across the entire measurement range for each operating variable, in order to create a complete table it is necessary to conduct multivariate multiple regression interpolation/extrapolation on the measured data. Preferably, a commercially-available software package, such as "Statistica" software, sold by StatSoft Company, Tulsa, Okla., is used to perform the interpolation/extrapolation, although other commercially available software packages may be used.

Once the table is prepared, one or more modifications are made to the thermal transfer system. The system is then operated, and the same variables measured until the trigger point is reached. The variable values during the measurement time are averaged, and the bin number for each variable average value is then determined. The database entry having corresponding bin numbers is then found, and the fuel usage measurement associated with that database entry is retrieved. The amount of fuel used after the modifications is then compared with this retrieved fuel usage value to determine the change in fuel usage caused by the modifications.

There is shown in FIG. 1 boiler system 10 employing the method of this invention of determining changes in energy usage resulting from modifications in the boiler system. The boiler system consists of boiler 12 and flue gas stack 14. Boiler 12 is fed with water and fuel. This invention contemplates the development of data from the boiler system, which in the preferred embodiment is accomplished as follows. Microcomputer 26 (a 486-DX-50, with 8 Mb RAM) is enabled to accept inputs comprising the fuel flow rate using flow meter transmitter 16, the steam output pressure and differential pressure using pressure and differential pressure meter 20 and 22, respectively. Steam temperature must also be included if the boiler produces superheated steam. The signals from transmitters 16, 18, 20 and 22 are typical 4–20 mA signals that are converted to 1–10 VDC signals by conditioners 32. These signals are digitized by A/D card 34. The windspeed, ambient temperature, and barometric pressure near the top of stack 14 are also collected using anemometer 24, temperature sensor 26, and pressure sensor 28, which are inputs to weather monitor station 30, that may be a Davis Instruments "Weather Monitor II", although other commercially-available weather monitoring instruments may be used. The data is acquired and processed by computer 36 using a commercially-available data acquisition program, for example the Labtech Control 4.21 data acquisition software development system. Hardware drivers are installed in weather monitor 30 to produce a serial output that is compatible with computer 36. Monitor 38 is used to display the data as described below in conjunction with FIG. 2.

The data is used by computer 36 to calculate the wind speed, ambient temperature, barometric pressure, gallons of fuel, steam gauge pressure, steam load in thousands of pounds per hour, and boiler output energy in millions of BTUs. The calculation of load and energy from the collected data is accomplished using information known in the field.

Figure 2:
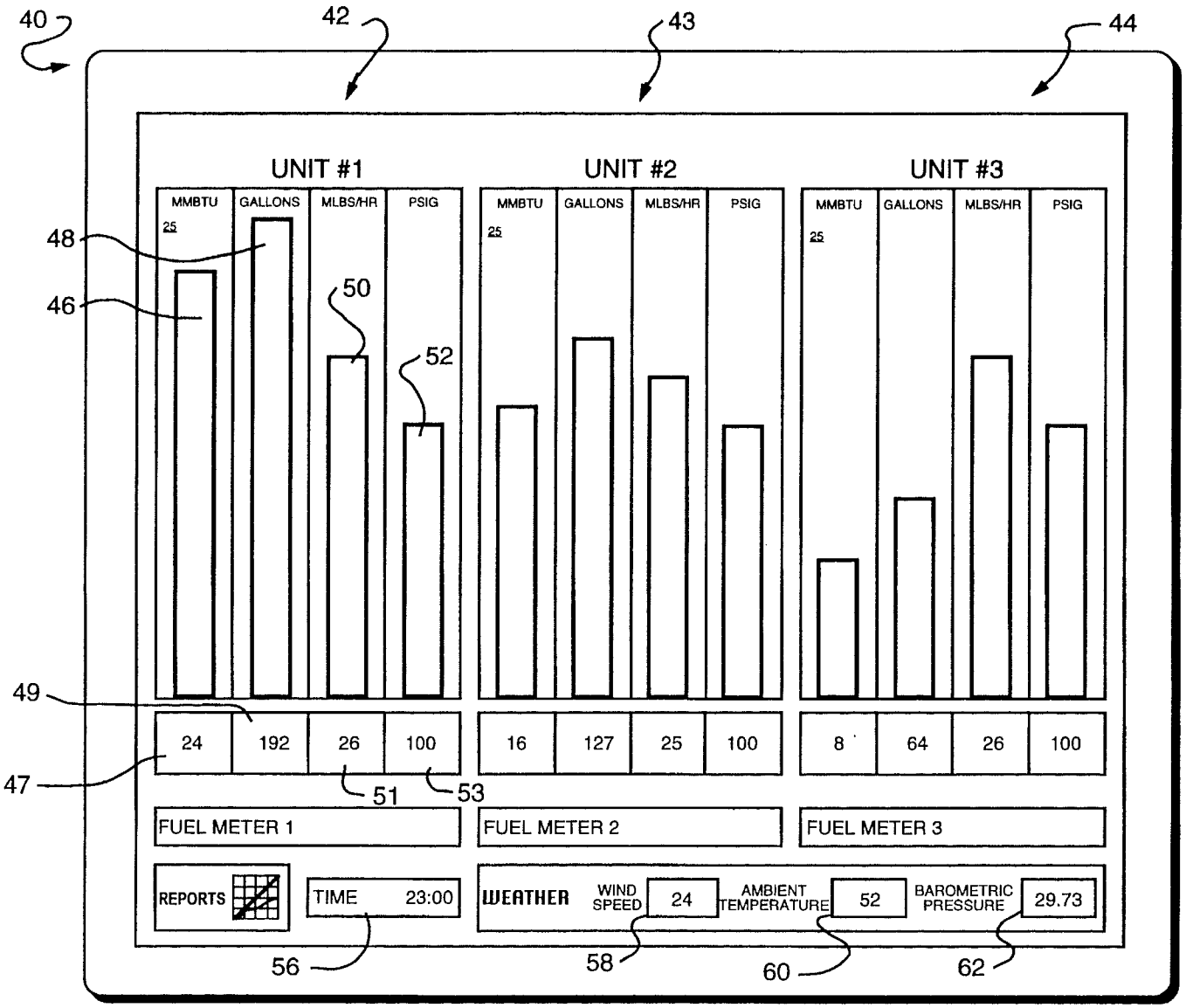
FIG. 2 is a diagram of one form of an output displayed on a monitor from the method of this invention.

One form of a display displayed on monitor 38 is shown in FIG. 2. Display 40 in this example consists of subdisplays 42 through 44, one for each of three boiler units in a power generating plant. Each sub-display, such as sub-display 42, includes a running total of millions of BTUs in the output steam stream, 46, and gallons of fuel burned to produce this amount of energy, 48. The load and steam pressure are displayed in real time, 50 and 52, respectively, and numerical values for bar charts 46, 48, 50, and 52, are below the bar charts, 47, 49, 51, and 53, respectively. The time of day is reported in area 56, and the wind speed, ambient temperature, and barometric pressure are also reported, 58, 60 and 62, respectively.

The basic methodology of this invention is to establish a trigger point which is either the production of a predetermined quantity of energy, or the burning of a predetermined quantity of fuel. The thermal transfer system is then operated until this trigger point is reached. Transmitted data, either in analog or digital format, from each of the transmitters is collected periodically, for example once per second, during this time period. In the example of FIG. 2, the trigger point is 25 million BTUs, indicated by the number 25 just above bar chart 46. The amount of fuel consumed to produce the selected amount of energy, along with averages of the operating variables during the energy production period, are then determined and saved.

Figure 3A:
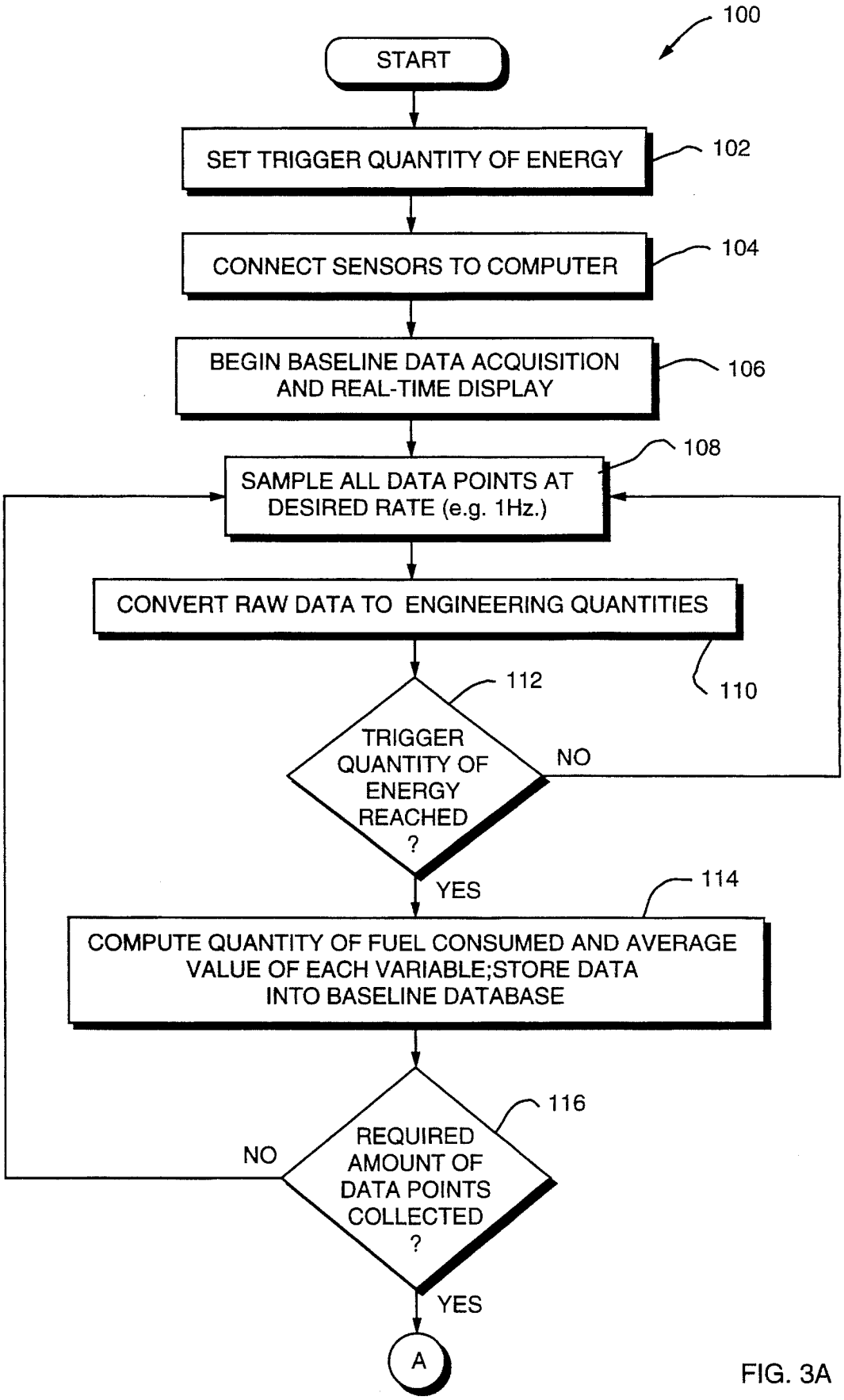
FIGS. 3A and 3B together are a flow chart of the preferred embodiment of the method of collecting baseline efficiency data for the method of this invention.
Figure 3B:
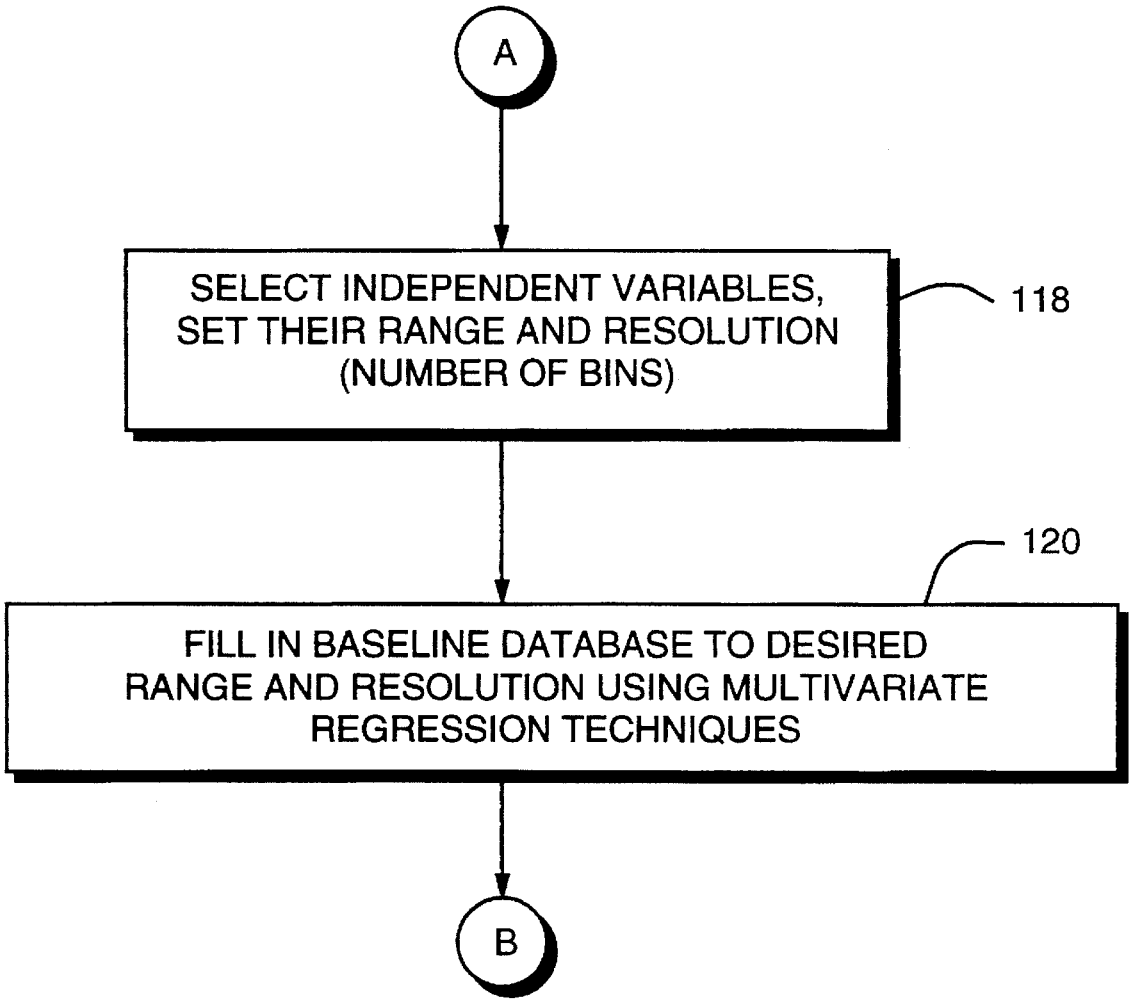

The preferred method of building a database of baseline system information, taken before the modifications are made to the operation of the system, is described in the flow chart of FIGS. 3A and 3B. Flow chart 100 begins with step 102, in which the operator establishes a trigger quantity of energy. In the example carried through in the description, there would be selected an amount in millions of BTUs. Alternatively, the operator could select a trigger point of gallons of fuel burned.

The sensors are connected to the computer, step 104, and data acquisition to fill in the constructed database is then begun, step 106. The real-time display of FIG. 2 is also enabled. Preferably, the trigger quantity of energy is selected to be small enough so that the operating system runs required to generate a single database entry are relatively short, no greater than one hour is recommended. When the test is begun, the computer acquires the value of each variable once per second, step 108. The data is converted to the desired engineering quantities, step 110. Some variable values are continuously reported, as shown in FIG. 2.

When the trigger of 25 million BTUs produced is reached, step 112, data acquisition ends. All the stored values for each variable are then averaged and the data is stored in a database, step 114. This process is repeated until enough data is collected to achieve a desired level of data in the database, step 116, so that the database can be accurately completed using interpolation techniques described below.

The operator would then set a range of values for each operating variable being measured. The range for each variable is then divided into a number of smaller segments, called "bins", step 118. The number of bins is selected by the operator. The number of database entries equals the number of bins raised to the power equal to the number of independent variables, assuming there are the same number of bins for each independent variable. The database entry with bin numbers matching those of the bin numbers determined for each variable average value of a single test is then resolved, and the quantity of fuel used in the run is then written into that database entry, step 114.

Data acquisition steps 108 through 114 are repeated a number of times to generate a fuel quantity for a number of different database entries. It is typically impractical to conduct enough tests to fill in the entire database, due to conditions outside of the control of the operator. For example, if the baseline data acquisition takes place during the summer months, the lower ranges of ambient temperatures will not be reached. All the ranges of barometric pressure and wind speed also may not be reached, especially since there are such a large number of possible of combinations of bin numbers in the database. Accordingly, it is necessary to complete the table by interpolating/extrapolating from existing data with a technique such as the multivariate regression technique of the "Statistica" software package from StatSoft Company, Tulsa, Okla.

Figure 4:
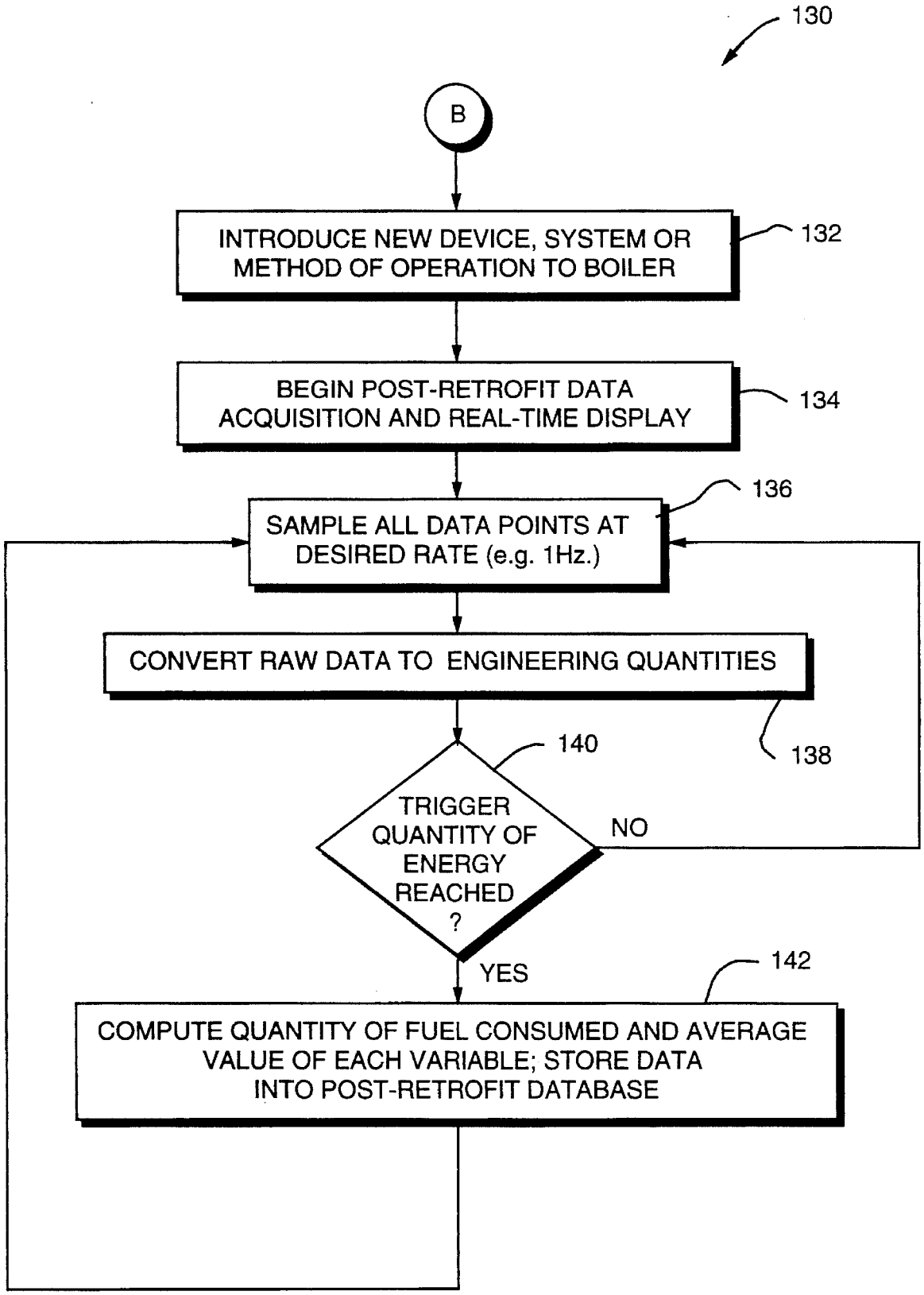
FIG. 4 is a flow chart of the preferred embodiment of the method according to this invention of measuring the energy transfer efficiency change resulting from modifications in a thermal transfer system.

Once the baseline database is complete, one or more modifications are made to the system. For example, a new burner nozzle may be installed, or the furnace draft may be altered in some manner. The effect of these modifications on the efficiency of the energy transfer system may then be determined as set forth in flow charts 130 and 150, FIGS. 4 and 5, respectively.

The modification is introduced, step 132, and the operator begins data acquisition, step 134. The system stores the variable values once per second, step 136, and the data is converted, step 138. When the trigger point is reached, step 140, data acquisition ends. All stored values of each operating variable are then averaged, and the amount of fuel consumed is computed and stored, step 142.

Figure 5:
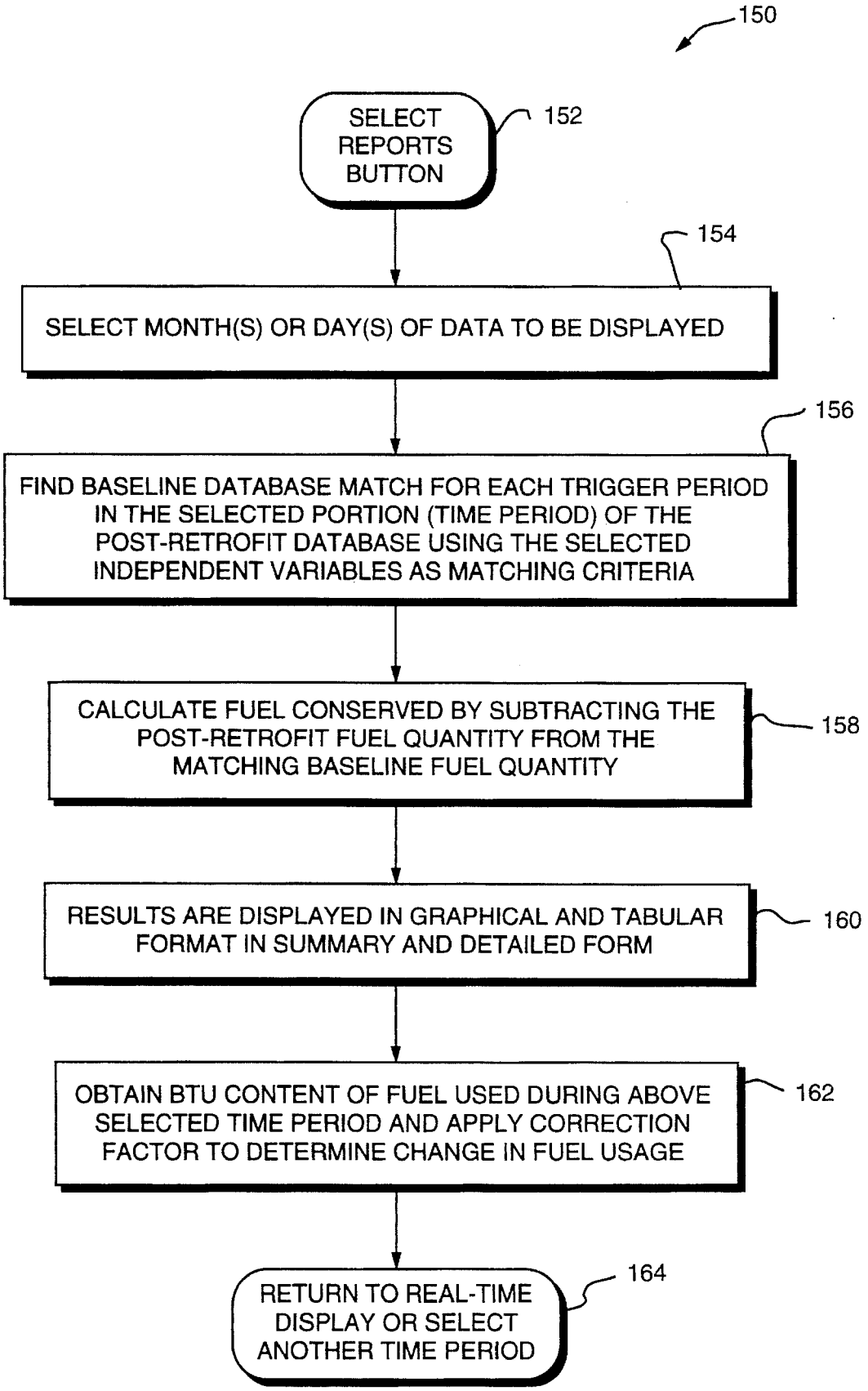
FIG. 5 is a flow chart of the preferred embodiment of the method of this invention of calculating fuel savings caused by the system modifications, and displaying the measurement results.

The change in the amount of fuel used to create the trigger point amount of energy is then determined and displayed as set forth in flow chart 150, FIG. 5. When the operator selects the "reports" icon, he is presented with a calendar which allows him to select an operating time period of any one or more days or months in which the stored data is displayed, and the fuel usage change determined and displayed.

At step 156, the computer finds a match in the baseline database for each trigger period in the time period selected by the operator. This database matching is accomplished as follows. The baseline database represents pre-modification consumption values for energy production periods under various conditions which affect efficiency. The baseline database is established in the form of a table, with a number of baseline database entries equal to the number of bins raised to the power of the number of independent variables. For example, if there are two bins and three independent variables, the database has $2^3$, or 8, entries, numbered 1 through 8. Table I sets forth such a database. The "baseline value" in the far right column would be the fuel consumption for the database entry number.

TABLE I

| db# | Variable 3-bin no. | Variable 2-bin no. | Variable 1-bin no. | Baseline Value |
|---|---|---|---|---|
| 1 | 0 | 0 | 0 | baseval_1 |
| 2 | 0 | 0 | 1 | baseval_2 |
| 3 | 0 | 1 | 0 | baseval_3 |
| 4 | 0 | 1 | 1 | baseval_4 |
| 5 | 1 | 0 | 0 | baseval_5 |
| 6 | 1 | 0 | 1 | baseval_6 |
| 7 | 1 | 1 | 0 | baseval_7 |
| 8 | 1 | 1 | 1 | baseval_8 |

The database entry number for the entry matching each trigger period is determined as follows. The bin number for the average value for each variable is first determined by subtracting the lowest data value of the range from the average value, and dividing the result by the width of the bins. The bin number is the greatest integer value less than or equal to the variable number. For example, if the temperature range is 20° to 100°, and there are eight bins, the 80° temperature range would be divided into ten-degree increment bins. The width of the bins would then be ten. If the average temperature for the currently-computed trigger period is 50°, the bin number for the temperature variable would be equal to 50–20÷10 or 3. If the temperature was 51, the bin number would be 4.

Once the bin numbers are determined for each of the independent variables, the database entry number is determined by the following equation:

$$\text{Database entry no.}=1+\text{Variable 1 bin no.}+\text{variable 2 bin no.}\times\text{no. bins}^{(2-1)}+\ldots\text{Variable } n \text{ bin no.}\times\text{no. bins}^{(n-1)}$$

Once the baseline database entry number is found, the baseline value (the amount of fuel used to establish the baseline database entry) is retrieved from the database. The post-modification fuel quantity is then subtracted from this quantity to determine the fuel savings associated with the modifications, step 158. The results are displayed in a desired form, such as graphically and in a tabular form, both in summary for the entire selected report period, and in detail for each trigger period of the entire report period. One or more corrections are then applied to the fuel savings to account for the BTU content of the fuel, and other post-data acquisition correction factors, for example a correction to account for soot or scale buildup on the heat exchanger tubes, in an attempt to attribute the fuel savings as closely as possible to only the modifications, step 162. These correction techniques are known in the art. Operation then returns to real time display, in which the operator may select another time period for calculation and display, step 164.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A method of determining changes in energy usage resulting from modifications in a thermal transfer system in which at least one variable selected from system variables and atmospheric variables are measured, comprising:

(a) selecting a quantity of transferred energy as a thermal transfer trigger point;

(b) establishing a database with a number of entries, each including a value for one or more selected variables, and a fuel quantity value;

(c) periodically measuring the values of the selected variables, until the thermal transfer trigger point is reached;

(d) determining the quantity of fuel used to transfer the selected quantity of energy;

(e) determining a single representative value for all of the measured values for each variable;

(f) creating a database entry including the single representative value for each variable, and the determined quantity of fuel;

(g) before the modifications, repeating steps (c) through (f) a number of times to establish a meaningful baseline database;

(h) after the system modifications, repeating steps (c) through (e);

(i) finding the database entry with selected variable values most closely matching the respective single representative values for the variables determined after the system modifications;

(j) retrieving the fuel quantity value which is part of the found database entry; and (k) comparing the quantity of fuel used to transfer the selected quantity of energy after the modifications, to the retrieved fuel quantity value to determine the effect of the modifications on the amount of fuel required to result in the transfer of the selected quantity of energy.

2. A method of determining changes in energy usage resulting from modifications in a thermal transfer system in which at least one variable selected from system variables and atmospheric variables are measured, comprising:

(a) selecting a quantity of fuel as a thermal transfer trigger point;

(b) establishing a database with a number of entries, each including a value for one or more selected variables and a transferred energy value;

(c) periodically measuring the values of the selected variables, until the thermal transfer trigger point is reached;

(d) determining the quantity of energy transferred as a result of the use of the quantity of fuel;

(e) determining a single representative value for all of the measured values for each variable;

(f) creating a database entry including the single representative value for each variable, and the determined quantity of transferred energy;

(g) before the modifications, repeating steps (c) through (f) a number of times to establish a meaningful baseline database;

(h) after the system modifications, repeating steps (c) through (e);

(i) finding the database entry with selected variable values most closely matching the respective single representative values for the variables determined after the system modifications;

(j) retrieving the transferred energy quantity which is part of the found database entry; and (k) comparing the quantity of energy transferred as a result of the use of the selected quantity of fuel after the modifications, to the retrieved transferred energy quantity to determine the effect of the modifications on the amount of energy transferred as a result of the use of the selected quantity of fuel.

* * * * *